US005441359A

United States Patent [19]

Filippi

[11] Patent Number: 5,441,359

[45] Date of Patent: Aug. 15, 1995

[54] COLLAPSIBLE VEHICULAR BARRIER

[75] Inventor: George C. Filippi, Philadelphia, Pa.

[73] Assignee: Filippi Brothers Inc., Philadelphia, Pa.

[21] Appl. No.: 194,042

[22] Filed: Feb. 9, 1994

[51] Int. Cl.[6] ..... E05B 65/00

[52] U.S. Cl. ..... 404/6; 49/35

[58] Field of Search ..... 404/6, 9, 10; 49/35, 49/49

[56] References Cited

U.S. PATENT DOCUMENTS

| | | | |
|---|---|---|---|
| 3,451,164 | 6/1969 | Kappelman | 49/35 |
| 4,003,161 | 1/1977 | Collins | 49/35 |
| 4,576,508 | 5/1986 | Dickinson . | |
| 4,715,742 | 12/1987 | Dickinson . | |
| 4,818,137 | 4/1989 | Gorlov . | |
| 4,919,563 | 4/1990 | Stice . | |
| 5,018,902 | 5/1991 | Miller et al. . | |
| 5,146,710 | 9/1992 | Caldwell | 404/6 X |

*Primary Examiner*—William P. Neuder
*Attorney, Agent, or Firm*—Howson & Howson

[57] ABSTRACT

A collapsible barrier for controlling vehicular access to parking areas and transitways, comprises a base and an elongated post hinged to the base. A first latch member fixed to the base engages a second latch member to secure the post in an upright obstructing position. The second latch member is located within the post and hinged to rotate about an axis parallel to the post hinge axis. An actuator, accessible from the exterior of the post, swings the second latch member in a direction to disengage it from the first latch member. A spring, operating in conjunction with camming surfaces on the latch members, provides for automatic reengagement when the post is rotated into the obstructing position.

19 Claims, 3 Drawing Sheets

COLLAPSIBLE VEHICULAR BARRIER

BRIEF DESCRIPTION OF THE INVENTION

This invention relates to apparatus for regulating vehicular traffic. It is specifically concerned with collapsible barriers which control vehicular access to parking areas and transitways.

The inherent dangers associated with the operation of motor vehicles make it particularly desirable to limit their access into certain areas. Barriers are therefore commonly used to obstruct the flow of traffic into areas such as pathways, roads, parking areas, and open other spaces which are physically accessible to vehicles, and yet vulnerable to the damage they cause.

Permanent barriers for blocking access to all vehicles are effective to protect areas which are only intended to serve pedestrians. Permanent barriers may also be made up of elements spaced apart from one another in order to obstruct large vehicles such as trucks, but to allow access by smaller vehicles. This provides adequate protection for areas which are not subject to damage by automobiles and motorcycles.

Removable barriers provide flexible access by obstructing vehicles at certain times, while allowing passage at other times. Removable barriers are particularly useful where emergency vehicles which must be admitted into areas that are normally blocked off to traffic. For example, universities, apartment complexes, libraries, corporate centers, and other facilities frequently protect pedestrians and property by prohibiting vehicles from being driven off of roads and driveways. Removable barriers allow emergency police, medical, and fire department vehicles access to areas thus protected.

Flexible vehicular access restriction is also used to prevent the public from parking in reserved parking areas. Removable barriers are particularly effective for doctors who require special parking at hospitals, officials at public buildings, and athletes at sporting events.

The need for flexible barrier systems to control vehicular access has led to a number of different kinds of barriers. Locked gates have long been used for obstructing vehicles of all types. Gates, however, also obstruct pedestrian traffic, and locks securing the gates are often exposed to the elements and become inoperable over time. The use of keys or combinations further encumbers emergency access, which at best slows down emergency personnel, and at worst bars their access.

U.S. Pat. No. 5,018,902, to Miller et al., describes a bollard which is hinged so that it can fold into a collapsed position. Inside the bollard, a latch bar mates with a protruding locking section rigidly connected to a base, to lock the bollard in an upright, obstructing position. A fireplug wrench is used to actuate the latch bar to disengage it from the locking section, by swinging it about an axis perpendicular to the hinge axis. For automatic reengagement, a hinge is provided in the latch bar, and the portion of the latch bar below the hinge is spring-urged so that it snaps into engagement with the locking section when the bollard housing is brought to its upright, obstructing position. The latch bar needs to be quite large so that a relatively small amount of rotation of the fireplug wrench produces enough movement of a remote portion of the latch base to clear the protruding locking section connected to the base. Consequently, a large movement is required to disengage the latch bar from the locking section. The force needed to disengage the latch bar from the locking section may increase over time as a result of corrosion, and consequently, release of the bollard may become increasingly difficult and failure may occur eventually.

U.S. Pat. Nos. 4,576,508 and 4,715,742, to Dickinson, describe bollards which are vertically depressible into underground mounting frames. The locking mechanisms of these bollards may, however, become exposed to the elements, causing them to freeze in position. These bollards are also expensive to install and dependent upon complex actuation mechanisms.

U.S. Pat. No. 4,919,563, to Stice, describes a vertically depressible bollard with a substantially self-contained actuation mechanism. This bollard is exceedingly complex, and is dependent upon an electrical power source, which is supplied either through an enclosed battery, or through wires from an outside power source.

The principal object of this invention is to provide a barrier to vehicular access which may be quickly and easily collapsed into a non-obstructing position. Another object of this invention is to provide a vehicular barrier with a simple, strong, durable, and reliable mechanism, which can be easily moved between the collapsed and obstructing positions, without the need for an electric or hydraulic power source. A further object of this invention is to provide a collapsible barrier to vehicular traffic which is simple and inexpensive to manufacture and to install.

In accordance with the invention, the collapsible barrier is installed to control the ingress and egress of vehicles into otherwise accessible areas. The barrier may be locked in an obstructing position, and may be manually collapsed to allow vehicles to pass.

The collapsible barrier in accordance with the invention comprises a base rigidly secured to the floor of the space into which it is installed. An elongated post, which obstructs vehicular access when vertically disposed, is connected to the base by a post hinge. The post hinge permits the post to swing about a post hinge axis between the obstructing and collapsed positions.

A first latch member is fixed to the base and engages a second latch member at a location lateral to the post hinge axis, thereby securing the post in the obstructing position. The second latch member is connected to the post by a second hinge providing an axis of rotation parallel to, and laterally spaced from, the post hinge axis. This allows the second latch member to rotate into and out of engagement with the first latch member. A manually operated actuator, accessible from the exterior of the post, effects this swinging movement of the second latch member about the second hinge axis, in a direction to disengage the second latch member from the first latch member.

A spring, connected to the post and to the second latch member, urges the second latch member in a direction to engage the first latch member. The first and second latch members have mutually engaging camming surfaces which effect swinging movement of the second latch member about the second hinge axis. This allows the first and second latch members to re-engage each other automatically when the post is moved into the obstructing position.

The collapsible barrier in accordance with the invention provides an effective barrier to vehicular access which may be swiftly collapsed into a non-obstructing position. The use of second latch member hinged to the post on a hinge axis parallel to the post hinge axis, allows the latch member to be disengaged easily from each other. Preferably, the second latch member is engaged by a separate actuating element so that it can move independently of the separate actuating element. This reduces the force required to move the second latch member during reengagement of the latch members, while making disengagement of the latch members easy.

This actuating mechanism is strong, reliable, durable, and easy to operate, and the collapsible barrier is inexpensive to manufacture and to install.

Further objects, details and advantages of the invention will be apparent from the following detailed description, when read in conjunction with the drawings.

DETAILED DESCRIPTION

Figure 1:
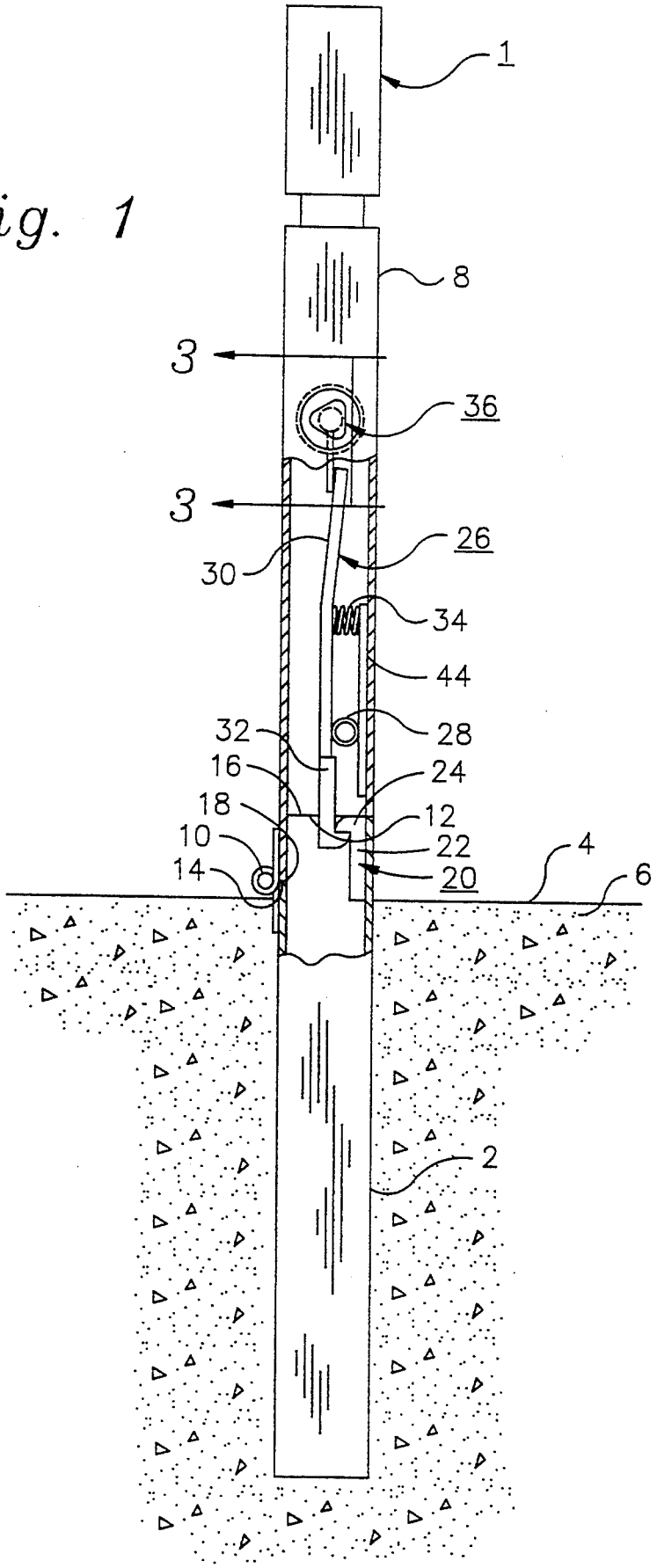
FIG. 1 is a partially broken-away elevational view of a collapsible barrier in accordance with the invention, with its post disposed in the obstructing position.
Figure 2:
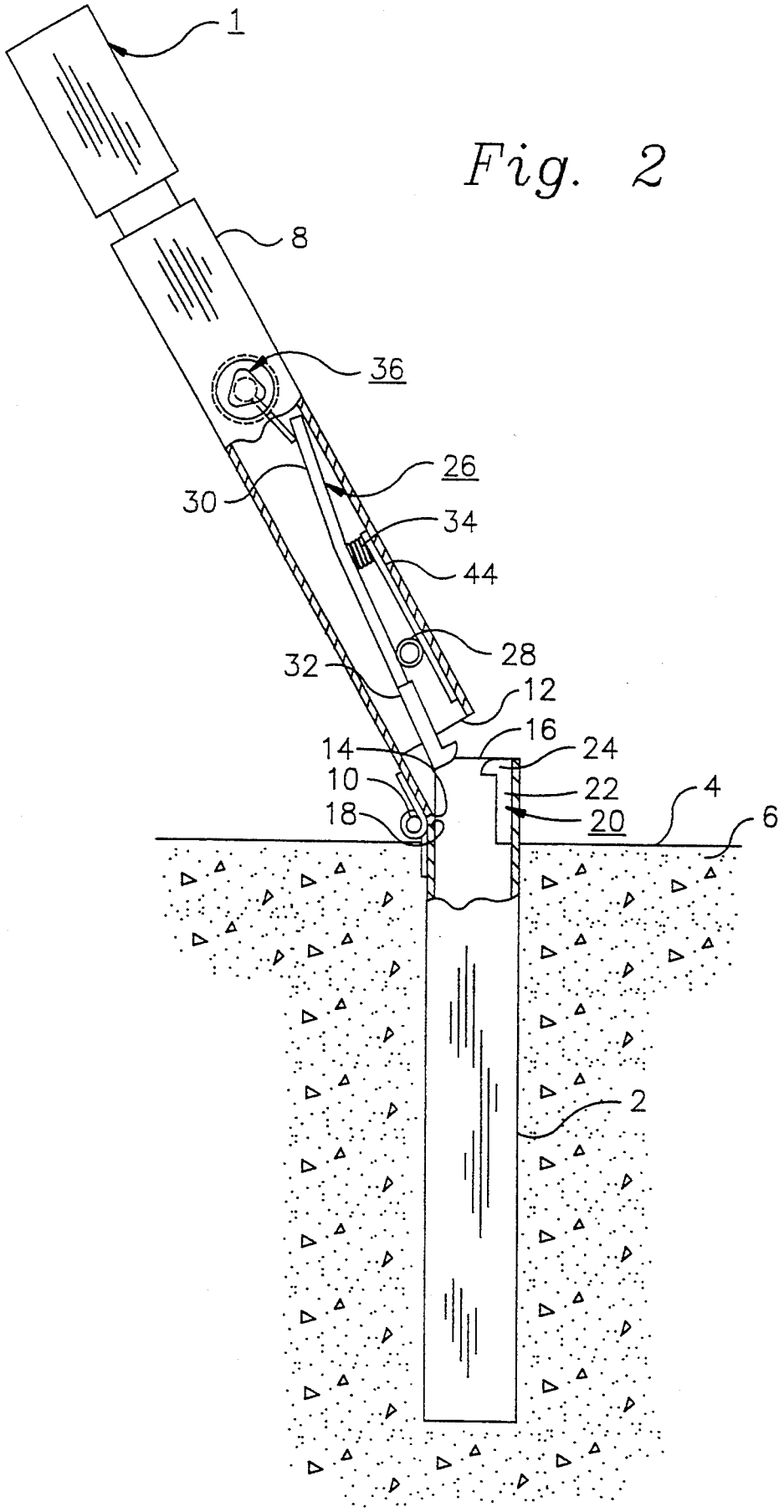
FIG. 2 is a partially broken-away elevational view of a collapsible barrier with the post disposed midway between its obstructing and collapsed positions.
Figure 3:
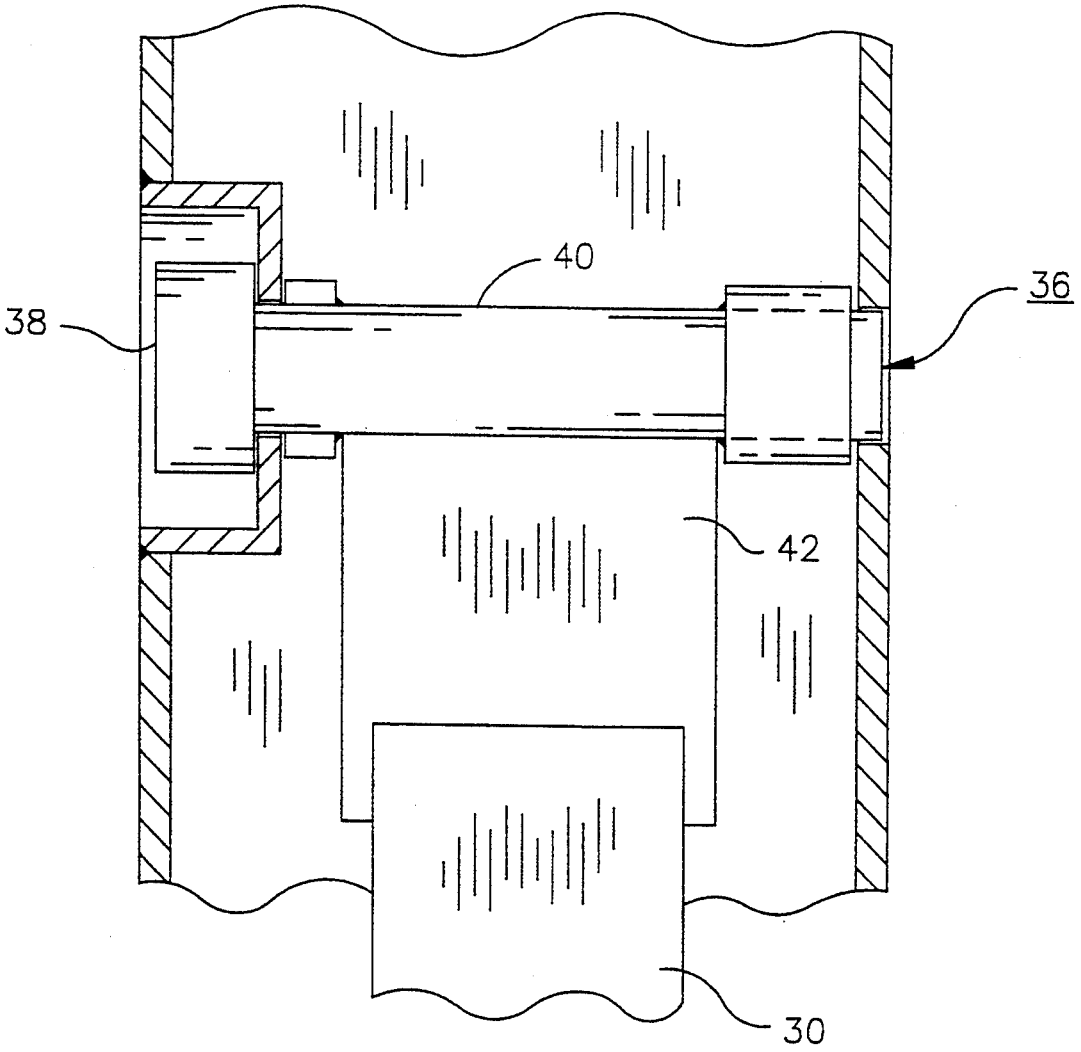
FIG. 3 is a sectional view of the collapsible barrier, taken on plane 3—3 of FIG. 1, showing the manually operated latch actuation assembly.

The collapsible barrier 1 shown in FIGS. 1, 2, and 3 comprises a base 2 firmly anchored to the floor 4 of the installation site. The base is preferably in the form of a thick-walled metal tube of rectangular cross-section. The base 2 is preferably embedded in a below grade concrete foundation 6.

An elongated post 8, which is also preferably in the form of a thick-walled metal tube having a rectangular cross-section, is connected to the base 2 by a post hinge 10, as shown in FIGS. 1 and 2. The hinge 10 is preferably located just above grade level. The post 8 rests on top of the base 2 so that the bottom edges 12 and 14 of the post are aligned with the top edges 16 and 18 of the base. The contiguous connection between the post 8 and base 2 is formed near floor level.

The post hinge 10 permits the post to swing about a horizontal post hinge axis, which is located adjacent to the connection between bottom portion 14 and top portion 18. The post 8 can therefore swing from the vertical position shown in FIG. 1, through the intermediate position shown in FIG. 2, to a substantially horizontal, collapsed condition in which it rests on floor 4.

In its collapsed condition, the post 8 allows vehicles to pass. Conversely, the post 8 physically obstructs vehicular access when disposed in an upright position with its direction of elongation substantially vertical as shown in FIG. 1. It is preferred that the post 8 be manufactured from stainless steel or other material with high impact and tensile strengths so that it is capable of sustaining light impacts without deformation, and remaining upright when subjected to heavier forces.

A first latch member 20 is rigidly welded to an inner wall of the base 2 at a location laterally spaced from the post hinge 10.

The first latch member 20 is composed of two sections, a lower section 22 and an upper section 24. The lower section 22 extends parallel to the direction of elongation of the post 8 in the obstructing position. The upper section 24 overhangs the lower section 22, and extends into the interior of the post 8. The bottom of the overhanging portion, which forms a latching surface, is flat. The upper side of the overhanging portion extending has a convex curvature forming a camming surface.

The portion of the base 2 connected to the first latch member 20 extends vertically above the floor to a height equal to that of the first latch member 20. This shields the first latch member 20 from impact when the post 8 is in the collapsed position. The post therefore meets the base at a location closer to the ground on the post hinge side, than on the opposite side.

A second latch member 26 is connected to the post 8 by a second hinge 28, which is mounted on an interior wall of the post by a plate 44, welded to the post. The second latch member 26 has an upper section 30 and a lower section 32. The upper section 30 is completely housed within the post 8. The lower section 32 is shaped similarly to the first latch member 20, having a flat upper surface for engaging the flat surface of section 24, and a convex camming surface on its lower side for engaging the camming surface of section 24.

The second latch member 26 is positioned on the second hinge 28 so that the overhanging portions of both latch members 20 and 26 engage each other when the post 8 is in the obstructing position. This engagement prevents the post 8 from rotating about the post hinge axis.

The second hinge 28 allows the second latch member 26 to rotate into and out of engagement with the first latch member 20 by providing an axis of rotation parallel to, and laterally spaced from, the post hinge axis. A compression spring 34 is connected between plate 44 and the upper section 30 of the second latch member 26. The spring urges the second latch member 26 about the second hinge axis in a direction to engage the first latch member 20 when the post 8 is rotated into the obstructing position.

The urging force of the spring 34 upon the second latch member 32 causes the opposing convex camming surfaces of both latch members 20 and 26 to come into contact with each other when the post is rotated toward its upright position. When the camming surfaces engage each other latch member 26 rotates clockwise about the axis of hinge 28. Ultimately, when the post is vertical, latch members 20 and 26 snap into engagement with each other under the action of spring 34. Thus, the latch members 20 and 26 automatically reengage when the post 8 is rotated into the obstructing position.

An actuator 36, mounted on post 8, provides for manual disengagement of the first latch member 20 from the second latch member 26. The actuator, as shown in FIG. 3 comprises an actuating element 38, located in a recess found in a wall of the post, and accessible from the exterior of the post 8. The actuator element 38, is preferably in the form of a triangle having rounded corners, so that it can be actuated by a fire plug wrench. The actuator element 38 is fixed to a shaft 40, which is mounted in the post for rotation about a horizontal axis substantially parallel to the axis of hinge 10. A tongue 42 is rigidly attached to shaft 40 and extends downwardly past the upper end of latch member 26.

When actuating element 38 is rotated, tongue 42 comes into contact with the upper section 30 of the second latch member 26. When the opposing force of spring 34 is overcome, the camming element 42 will rotate the second latch member 26 counterclockwise about the second hinge axis. This rotation disengages the lower section 32 of the second latch member 26 from the upper section 24 of the first latch member 20.

The post 8 is then free to rotate about the post hinge 10 into the collapsed position.

The collapsible barrier 1 in accordance with the invention provides a flexible system for controlling vehicular access. It may function as a barrier to vehicles, or be folded into the collapsed position to allow them to pass. The use of a hinged latching element and a separate actuator allows the barrier to be folded to its collapsed condition swiftly and easily. The use of a second latch member hinged on an axis parallel to the post hinge, and a separate actuator provides for ease of operation and long-term reliability. The fact that the second latch member is connected to the post by a single articulating connection, provided by hinge 28, rather than through multiple articulating connections, enhances the strength of the barrier. The fact that the axis of hinge 28 is parallel to the axis of hinge 10 also contributes to the strength of the barrier. The barrier 1 is not only strong, reliable and durable, but also inexpensive to manufacture and to install.

Various changes may be made to the described embodiments. While a triangular device actuable by a fire plug wrench is preferred as the actuating element, any suitable device accessible from the exterior of the post 8 may be used to push the upper section 30 of the second latch element 26.

The base 2 does not need to be inserted into a below grade level foundation. Any method of affixing the base to the floor of the installation site may be utilized. For example the base 2 can take the form of a plate anchored to a floor by bolts.

The post 8 may be fashioned into any of various sizes and shapes. Large posts may be used to block trucks, while smaller ones may provide a sufficient barrier to motorcycles and automobiles.

Still other modifications, which will occur to persons skilled in the art, may be made without departing from the scope of the invention as defined in the following claims.

I claim:

1. A Collapsible barrier for controlling vehicular access to an area having a floor, comprising: a base adapted to be rigidly secured to the floor of the area;

means comprising an elongated post, for obstructing vehicular access when the post is disposed in an upright condition in which its direction of elongation is substantially vertical;

post hinge means connecting the post to the base, said post hinge means having a post hinge axis, and permitting swinging movement of the post about said post hinge axis, from the upright condition to a collapsed condition in which the post is disposed with its direction of elongation approximately horizontal;

latch means for securing the post in its upright condition, the latch means comprising a first latch member fixed to the base, and a second latch member engageable with the first latch member at a location spaced laterally from the post hinge axis;

second hinge means connecting the second latch member to the post, and having a second hinge axis substantially parallel to, but laterally spaced from, the post hinge axis, whereby the second latch member can rotate about said second hinge axis, into and out of engagement with said first latch member;

spring means, connected to the post and to the second latch member, for exerting a force urging said second latch member in a direction to engage the first latch member;

means, accessible from the exterior of the post, for effecting swinging movement of the second latch member about the second hinge axis, while the post is disposed in said upright condition, in a direction to disengage the second latch member from the first latch member;

said first and second latch members having mutually engaging camming surfaces for effecting swinging movement of the second latch member about the second hinge axis against the force exerted by the spring means, for allowing said first and second latch members to engage each other automatically when the post is moved into its upright condition.

2. A collapsible barrier according to claim 1 wherein the post is hollow, and the second hinge means, the spring means and at least part of the second latch member are disposed substantially entirely within the post.

3. A collapsible barrier according to claim 1 wherein the means, accessible from the exterior of the post, for effecting swinging movement of the second latch member about the second hinge axis, in a direction to disengage the second latch member from the first latch member, is an actuator separable from the second latch member so that second latch member can swing independently of said actuator.

4. A collapsible barrier according to claim 3 wherein the means, accessible from the exterior of the post, for effecting swinging movement of the second latch member about the second hinge axis, in a direction to disengage the second latch member from the first latch member, comprises a shaft mounted in the post for rotation about an axis substantially parallel to the post hinge axis.

5. A collapsible barrier according to claim 1 wherein the second latch member comprises upper and lower sections, said sections being located on opposite sides of the second hinge means.

6. A collapsible barrier according to claim 1 having a plate with first and second sides, the first side being rigidly attached to the post and the second side being connected to the second latch member through the second hinge means.

7. A collapsible barrier according to claim 6 wherein the spring means, for urging the second latch member into engagement with the first latch member when the post is rotated into the obstructing position, is connected to the second side of said plate and to the second latch member.

8. A collapsible barrier according to claim 1 having a below grade level foundation in which said base is embedded.

9. A collapsible barrier according to claim 1 wherein said spring means is a compression spring.

10. A collapsible barrier for controlling vehicular access to an area having a floor, comprising:

a substantially hollow and elongated post;

post hinge means, having a post hinge axis, for permitting the post to rotate into an obstructing position in which its direction of elongation is substantially vertical, and a collapsed position in which its direction of elongation is substantially horizontal;

latch means for rigidly locking the post into the obstructing position, the latch means comprising a fixed first latch member laterally spaced from the post hinge means, and a second latch member pivoted on the post to rotate about a pivot axis substantially parallel to the post hinge axis, for engagement with the first latch member; and latch actuation means for disengaging the second latch member from the first latch member by causing said second latch member to rotate about said pivot axis to a position in which it is disengaged from said first latch member while the post is in said obstructing position, the latch actuation means comprising an actuator arm engageable with, but separable from, the second latch member.

11. A collapsible barrier for controlling vehicular access to an area having a floor, comprising:

a base adapted to be rigidly secured to the floor of the area;

a hollow, elongated post;

post hinge means, having a post hinge axis, for permitting the post to rotate into an obstructing position in which the post is disposed with its direction of elongation substantially vertical, and a collapsed position in which the post is disposed with its direction of elongation substantially horizontal;

latch means for rigidly locking the post into the obstructing position, the latch means comprising a first latch member rigidly attached to the base and laterally spaced from the post hinge means, and a second latch member pivoted on the post for rotation about a pivot axis substantially parallel to the post hinge axis, for engagement with the first latch member;

reengagement means for automatically snapping the second latch member into engagement with the first latch member when the post is rotated into the obstructing position; and latch actuation means for disengaging the second latch member from the first latch member by causing said second latch member to rotate about said pivot axis to a position in which it is disengaged from said first latch member while the post is in said obstructing position, the latch actuation means comprising an actuator arm engageable with the second latch member.

12. A collapsible barrier according to claim 11 wherein the latch actuation means comprises a manually operated actuator accessible from the exterior of the post and rigidly connected to the actuator arm.

13. A collapsible barrier according to claim 12 wherein the manually operated actuator comprises a shaft mounted in the post for rotation about an axis substantially parallel to the post hinge axis.

14. A collapsible barrier according to claim 12 wherein the manually operated actuator comprises a triangular actuator element engageable by a fire plug wrench.

15. A collapsible barrier according to claim 11 wherein the reengagement means comprises spring means arranged to urge the second latch member in a direction to engage the first latch member when the post is rotated into the obstructing position.

16. A collapsible barrier according to claim 15 wherein the first and second latch members have mutually engaging camming surfaces for effecting swinging movement of the second latch member about its pivot axis against the force exerted by the spring means, whereby said first and second latch members engage each other automatically when the post is moved into its upright condition.

17. A collapsible barrier according to claim 11 having a plate with first and second sides, the first side being rigidly attached to the post, and the second side being pivotally connected to the second latch member.

18. A collapsible barrier according to claim 17 wherein the reengagement means comprises a compression spring, connected to the second side of said plate and to the second latch member, for urging the second latch member in a direction to engage the first latch member when the post is rotated into the obstructing position.

19. A collapsible barrier according to claim 11 having a below grade level foundation in which said base is embedded.

* * * * *